US005495740A

United States Patent [19]

Schwarze

[11] Patent Number: 5,495,740

[45] Date of Patent: Mar. 5, 1996

[54] PIPE BENDING MACHINE

[76] Inventor: Rigobert Schwarze, Olpener Str. 462, 51109 Koeln, Germany

[21] Appl. No.: 292,180

[22] Filed: Aug. 19, 1994

[30] Foreign Application Priority Data

Oct. 21, 1993 [DE] Germany ..... 9316052 U

[51] Int. Cl.[6] ..... B21D 7/02

[52] U.S. Cl. ..... 72/149; 72/159; 72/158; 72/217

[58] Field of Search ..... 72/149, 157, 158, 72/159, 217

[56] References Cited

U.S. PATENT DOCUMENTS 2,455,138 11/1948 Perkins ..... 72/158
4,495,788 1/1985 Traub ..... 72/157
4,765,168 8/1988 Strange et al. ..... 72/149
5,343,725 9/1994 Sabine ..... 72/149

*Primary Examiner*—Lowell A. Larson
*Assistant Examiner*—Rodney Butler
*Attorney, Agent, or Firm*—Diller, Ramik & Wight

[57] ABSTRACT

The pipe bending machine comprises a rotatable bending template (14) and a pivot arm (21) pivotable about the axis of the bending template and supporting a clamping jaw (22). In order to be able to perform rightward bending as well as leftward bendings of a pipe (27), the bending template (14) consists of two template parts (15,16) configured for different bending directions. The clamping jaw (22) also consists of jaw parts (23,24) for different bending directions. On both sides of the bending head, slide rails (32,33) are arranged.

9 Claims, 1 Drawing Sheet

PIPE BENDING MACHINE

BACKGROUND OF THE INVENTION

The present invention relates to a pipe bending machine comprising a bending template rotatable about a vertical axis, a pivot arm pivotable about the axis of the bending template and comprising a clamping jaw for clamping a pipe section on the bending template, and a slide rail comprising an abutment for the non-bent pipe section.

Known pipe bending machines have a rotatable bending template comprising a bending groove on its periphery, which receives part of the section of the pipe to be bent. The pipe is pressed into the pipe bending groove by means of a clamping jaw fastened to a pivot arm. Upon pivoting the pivot arm and simultaneously rotating the bending template about the axis of the bending template, the pipe is drawn around the bending template, which produces a pipe bend. In the case of pipes which are initially straight, it does not matter whether the pipe is bent to the right or to the left. Oftentimes, however, pipes have to be bent in opposite senses, i.e. with a rightward bend and subsequently with a leftward bend. These bends may be very close to each other. In such cases, the pipe cannot be turned after having made the first bend in order to make the second bend because such turning is prevented by the parts of the bending machine.

SUMMARY OF THE INVENTION

It is the object of the present invention to provide a pipe bending machine by which also complex pipe forms with very closely adjoining bends can be produced.

In the pipe bending machine according to the invention, the pivot arm can be pivoted by full 180° and the bending tools are configured such that they are suited for rightward bending as well as leftward bending. Accordingly, a pipe may optionally be set against the bending template from the left or from the right side. For rightward bending and leftward bending, respectively, a separate slide rail is provided which serves as abutment or lateral support for the pipe section not to be bent. By means of the pipe bending machine according to the invention, a pipe can be provided with a rightward bend as well as a leftward bend, there also being the possibility of first rotating the pipe about the longitudinal axis of the pipe clamping device. If, upon performing a rightward bending, an already pre-bent pipe is shaped such that it collides with parts of the pipe bending machine, the pipe can be put against the opposed side of the bending template and deformed by bending it to the left. Further, it is possible to perform rightward bendings and leftward bendings of a pipe successively, without being forced to turn the pipe.

Due to the choice of sense of rotation, the pipe bending machine allows the production of complex pipe shapes on a single machine or also the further processing of pre-bent pipes which could not be bent on a machine having one bending direction only.

Advantageous embodiments and developments of the invention are apparent from the subclaims.

BRIEF DESCRIPTION OF THE DRAWINGS

Hereinafter, a preferred embodiment of the invention is described in detail in conjunction with the drawings, in which.

DESCRIPTION OF THE PREFERRED EMBODIMENT

Figures 1, 2:
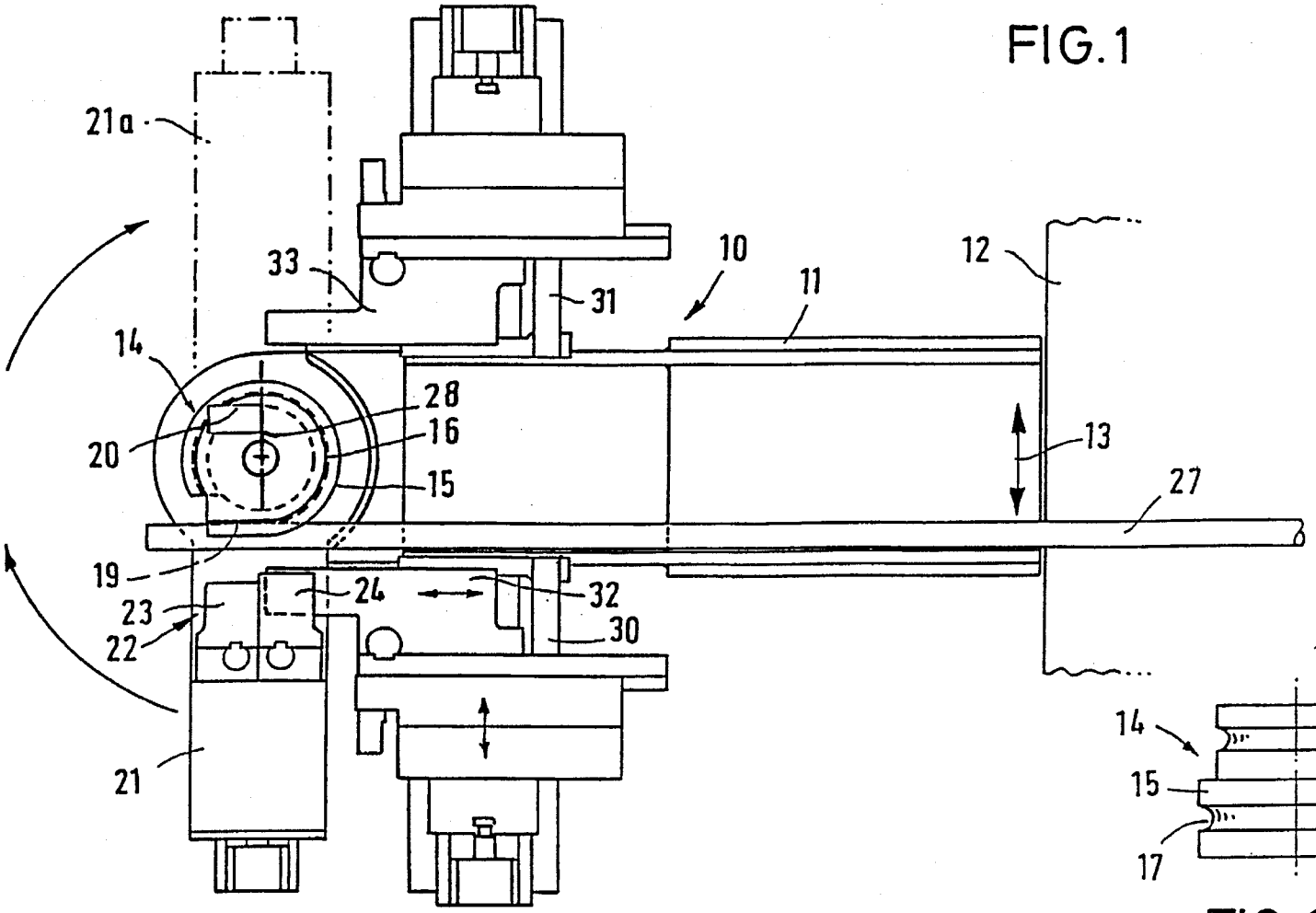
FIG. 1 is a top plan view onto the bending head of a pipe bending machine.
FIG. 2 is a schematic side view of the bending template and the clamping jaw.

The pipe bending machine comprises a bending head 10 having an arm 11 projecting horizontally from an end wall of the machine frame 12. On the front wall of the machine frame 12, the arm 11 may be displaced horizontally, as indicated by the arrow 13, and also vertically.

The bending template 14 consisting of two template parts 15 and 16 arranged on top of each other is located at the front end of arm 11. Each template part is shaped like a substantially cylindrical thick disc being provided with a bending groove 17 and 18, respectively, on its periphery. The bending groove, however, does not extend over the entire periphery of the template part but ends in a tangential clamping piece 19 and 20, respectively.

A pivot arm 21 radially projecting from the bending template is supported on a bearing arranged coaxially to the bending template 14. The clamping jaw which can be moved by a linear drive (not shown) along the pivot arm 21 is located on this pivot arm. The clamping jaw comprises two jaw parts 23 and 24 which are arranged beside each other, but at different heights. The lower jaw part 23 is located level with the lower template part 15 and the upper jaw part 24 is located level with the upper template part 16. Both jaw parts are advanced and retracted together, but it is also possible to separately control the jaw parts. Since the jaw part 24 cooperates with the template part 16 of smaller diameter, it projects farther toward the bending template 14 than the jaw part 23. Either one of the jaw parts 23 and 24 comprises a groove 25 and 26, respectively, which encompasses a part of the circumference of the pipe 27 to be bent, while another part of the circumference lies in the corresponding bending groove 17 or 18, respectively, of the bending template 14.

The template part 15 is provided for rightward rotation (clockwise), i.e. the bending groove 17 extends counterclockwise from the clamping part 19 thereof. The template part 16, however, is provided for leftward rotation, i.e. the bending groove 18 extends clockwise from the clamping part 20 thereof. Both clamping parts 19 and 20 are located on the same side of a diameter 28 of the bending template 14.

From the arm 11, slide rail carriers 30 and 31 extend to opposite sides. Each slide rail carrier 30 carries a slide rail 32 and 33, respectively, extending parallel to the arm 11 and serving to absorb the counterforce of the pipe produced upon pipe bending and to laterally support the pipe 27. The slide rails can respectively be displaced along their slide rail carrier 30,31 by means of a drive means. The slide rail 32 is effective when the jaw part 23 is used. Accordingly, it is level with the jaw part 23 and the template part 15. With respect thereto, the slide rail 33 is located at a higher position. It is used when the pipe 27 is put against the opposed side of the bending template and the jaw part 24 is used.

Further, either one of the slide rails 32 and 33 is provided with a longitudinal drive to be able to follow the pipe during the bending operation.

In the position of the pivot arm 21 shown in full lines, the clamping jaw 22 is oriented transversely to the arm 21 and to the direction of the pipe 27 and it is located on the left side of the bending template 14. The lower jaw part 23 is arranged on the left side of the diameter 28 and the jaw part 24 on the right side. When the clamping jaw 22 is advanced, the pipe is clamped between the jaw part 23 and the clamping part 19. By rotating the bending template 14, a rightward bend in the pipe 27 is made. At this time, the lower slide rail 32 is in the advance position so that it supports the pipe and absorbs the counterforce. A part of the slide rail 32 projects under the jaw part in order to also have a supporting effect near the diameter 28.

If the pipe 27 is to be bent leftward, it is put against the opposed side of the bending template, in the height of the upper template part 16. The pivot arm 21 is then in the position 21*a* pivoted by 180°. The lower jaw part 23 which is not used projects under the front end of the slide rail 33. When the clamping jaw 22 is advanced, the upper jaw part 24 presses the pipe against the upper template part 16. The upper slide rail 33 is advanced to laterally support the pipe. From the position 21*a* of the pivot arm, a leftward rotation is then performed, a section of the pipe being drawn around the template member 16 and thus being bent.

I claim:

1. A pipe bending machine comprising a bending template (14), pivot means for effecting rotation of said bending template in opposite directions about an axis of said pivot means, a pivot arm (21), said pivot arm (21) being pivotable through substantially 180 degrees, a clamping jaw (22) carried by said pivot arm (21), a pair of slide rails (32, 33) disposed on opposite sides of said bending template (14); said bending template (14) and clamping jaw (22) having cooperative means (18 or 19; 23 or 24, respectively) for clamping a pipe and effecting bending thereof upon pivoting of said pivot arm (21) in opposite directions with contemporaneous rotation of said bending template (14), cooperative counterforce absorption being effected by a selective one (32 or 33) of said pair of slide rails (32, 33) during pivoting of said pivot arm (21) in said opposite directions, and said cooperative clamping means (18 or 19; 23 or 24, respectively) being operative absent reversal of said clamping jaw (22) and said pivot arm (21).

2. The pipe bending machine as defined in claim 1 wherein said bending template (14) includes two superposed template parts (15, 16), said clamping jaw (22) includes two superposed jaw parts (23, 24), and upper and lower of said template parts (15, 16) and jaw parts (23, 24) are substantially aligned for cooperative interaction during pivoting of said pivot arm (21) in said respective first and second directions.

3. The pipe bending machine as defined in claim 2 wherein said one (32) and said second (33) slide rails (32, 33) project respectively under and over respective upper (24) and lower (23) jaw parts.

4. A pipe bending machine comprising a bending template (14), pivot means for effecting rotation of said bending template in opposite directions about an axis of said pivot means, a pivot arm (21), said pivot arm (21) being pivotable through substantially 180 degrees about said pivot means and the axis thereof, a clamping jaw (22) carried by said pivot arm (21), a pair of slide rails (32, 33) disposed on opposite sides of said bending template (14); said bending template (14) and clamping jaw (22) having cooperative means (18 or 19; 23 or 24, respectively) for clamping a pipe and effecting bending thereof upon pivoting of said pivot arm (21) in opposite directions with contemporaneous rotation of said bending template (14), cooperative counterforce absorption being effected by a selective one (32 or 33) of said pair of slide rails (32, 33) during pivoting of said pivot arm (21) in said opposite directions, and said cooperative clamping means (18 or 19; 23 or 24, respectively) being operative absent reversal of said clamping jaw (22) and said pivot arm (21).

5. The pipe bending machine as defined in claim 4 wherein said bending template (14) includes two superposed template parts (15, 16), said clamping jaw (22) includes two superposed jaw parts (23, 24), and upper and lower of said template parts (15, 16) and jaw parts (23, 24) are substantially aligned for cooperative interaction during pivoting of said pivot arm (21) in said respective first and second directions.

6. The pipe bending machine as defined in claim 5 wherein said one (32) and said second (33) slide rails (32, 33) project respectively under and over respective upper (24) and lower (23) jaw parts.

7. A pipe bending machine comprising a bending template (14) mounted for selective rotation in opposite directions about an axis, a pivot arm (21) being pivotable through substantially 180 degrees, a clamping jaw (22) carried by said pivot arm (21), a pair of slide rails (32, 33) disposed on opposite sides of said bending template (14); said bending template (14) and clamping jaw (22) having cooperative first means (19, 23, respectively) for clamping a pipe and effect bending thereof upon pivoting of said pivot arm (21) in a first of said opposite directions with contemporaneous rotation of said bending template (14) in said first direction and cooperative counterforce absorption being effected by one (32) of said pair of slide rails (32, 33); said bending template (14) and clamping jaw (22) having cooperative second means (18, 24, respectively) for clamping a pipe and effect bending thereof upon pivoting of said pivot arm (21) in a second of said opposite directions with contemporaneous rotation of said bending template (14) in said second direction and cooperative counterforce absorption being effected by a second (33) of said pair of slide rails (32, 33), and said first and second cooperative clamping means (19, 23 and 18, 24, respectively) being operative absent reversal of said clamping jaw (22) and said pivot arm (21).

8. The pipe bending machine as defined in claim 7 wherein said bending template (14) includes two superposed template parts (15, 16), said clamping jaw (22) includes two superposed jaw parts (23, 24), and upper and lower of said template parts (15, 16) and jaw parts (23, 24) are substantially aligned for cooperative interaction during pivoting of said pivot arm (21) in said respective first and second directions.

9. The pipe bending machine as defined in claim 8 wherein said one (32) and said second (33) slide rails (32, 33) project respectively under and over respective upper (24) and lower (23) jaw parts.

* * * * *